US006609887B2

(12) United States Patent
Moreau et al.

(10) Patent No.: US 6,609,887 B2
(45) Date of Patent: Aug. 26, 2003

(54) FAN FOR A MOTOR VEHICLE, EQUIPPED WITH GUIDE VANES

(75) Inventors: Stéphane Moreau, Paris (FR); Manuel Henner, Auffargis (FR); Pierre Baude, Nay (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/845,257

(22) Filed: May 1, 2001

(65) Prior Publication Data

US 2002/0006331 A1 Jan. 17, 2002

(30) Foreign Application Priority Data

May 5, 2000 (FR) ..... 00 05787

(51) Int. Cl.[7] ..... F04D 29/54

(52) U.S. Cl. ..... 415/211.2; 416/169 A

(58) Field of Search ..... 415/211.2; 416/169 A, 416/DIG. 5, 234, 241 A

(56) References Cited

U.S. PATENT DOCUMENTS

| | | | | |
|---|---|---|---|---|
| 2,219,499 A | | 10/1940 | Troller | |
| 3,924,964 A | * | 12/1975 | Lievens et al. | 415/210 |
| 4,219,325 A | * | 8/1980 | Gutzwiller | 432/199 |
| 4,451,202 A | * | 5/1984 | Hauser | 4116/214 R |
| 5,246,339 A | * | 9/1993 | Bengtsson et al. | 415/208.1 |
| 5,470,200 A | * | 11/1995 | Tupov et al. | 415/195 |
| 5,511,942 A | * | 4/1996 | Meier | 415/220 |
| 5,551,841 A | * | 9/1996 | Kamada | 417/89 |

FOREIGN PATENT DOCUMENTS

| | | |
|---|---|---|
| DE | 4105378 | 8/1992 |
| DE | 19948074 | 4/2000 |
| EP | 0499166 | 8/1992 |
| GB | 2156007 | 10/1985 |
| JP | 407332088 A * | 12/1995 |

* cited by examiner

*Primary Examiner*—Ninh H. Nguyen
(74) *Attorney, Agent, or Firm*—Liniak, Berenato & White

(57) ABSTRACT

A fan in which, in order to improve straightening of the airflow, the axial length (L) of the guide vanes lies between 40 and 60 mm, and their angle of inclination Ω with respect to a radial plane lies between 25 and 35°.

13 Claims, 2 Drawing Sheets

FAN FOR A MOTOR VEHICLE, EQUIPPED WITH GUIDE VANES

BACKGROUND OF THE INVENTION

The invention relates to a fan for a motor vehicle, especially for cooling the engine, comprising a stator and a rotor which is able to turn with respect to the stator about an axis in such a way as to produce an airflow in the direction of the said axis, the rotor and the stator respectively featuring blades and guide vanes which extend substantially radially into the said airflow, the guide vanes being situated downstream of the blades with respect to the airflow.

The rotor or impeller of an axial fan produces a substantially helical movement of the air, and the guide vanes have the function of straightening out this movement so as to make it parallel to the axis and thus to enhance the aerodynamic efficiency-of the fan.

The guide vanes used hitherto in motor-vehicle fans had an axial length, that is to say a dimension in the direction of the axis of rotation of the rotor, of the order of 20 mm, which was regarded as sufficient to ensure effective straightening of the airflow. However, new means of analysis have revealed that such was not the case, and that the known vanes were allowing a not inconsiderable circumferential component of the movement of the airflow to persist.

One aim of embodiments of the invention is to improve the geometric characteristics of the guide vanes in such a way as to obtain a practically perfect straightening of the airflow.

SUMMARY OF THE INVENTION

The invention especially envisages a fan of the type defined in the introduction, and provides for the axial length of the guide vanes to be equal to 40 mm at least.

Optional characteristics of the invention, which are complementary or alternative, are set out below:

- the axial length of the guide vanes is equal to 60 mm at most. Beyond this value, the axial bulk of the stator increases without any benefit as regards the aerodynamic efficiency;
- the acute angle Ω between the chord of the flattened cross section of a vane and a radial plane lies between 25 and 35°;
- the angle Ω decreases progressively at least over the last 30% of the radial span of the vane;
- the vanes have an aerodynamic camber lying between 1.5 and 2.5;
- the vanes are produced in a single piece with a substantially annular central core from which they extend substantially radially outwards;
- the vanes are produced in a single piece with an annular peripheral ring from which they extend substantially radially inwards;
- the vanes are molded from a material chosen from a plastic and/or a magnesium-based material;
- the stator and the rotor have an outer diameter lying between 200 and 500 mm;
- the rotor is able to turn at a speed lying between 1500 and 4000 rpm.

BRIEF DESCRIPTION OF THE DRAWINGS

The characteristics and advantages of the invention will be set out in greater detail in the description below, by referring to the attached drawings.

DETAILED DESCRIPTION OF THE INVENTION

Figure 1:
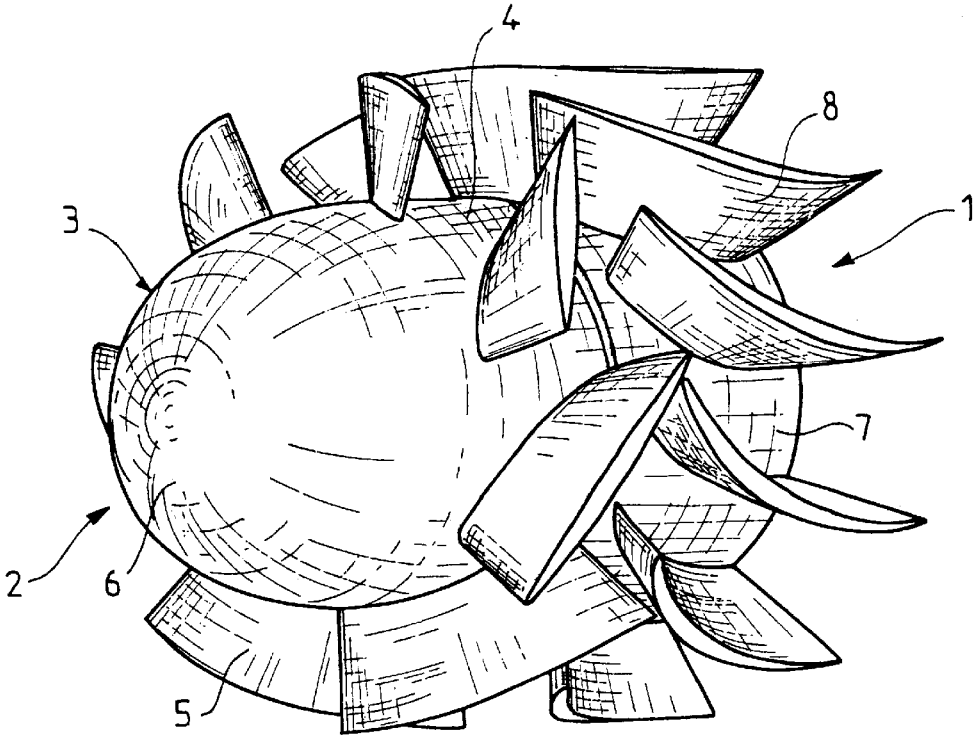
FIG. 1 is a perspective view of a fan according to the invention.
Figure 3:
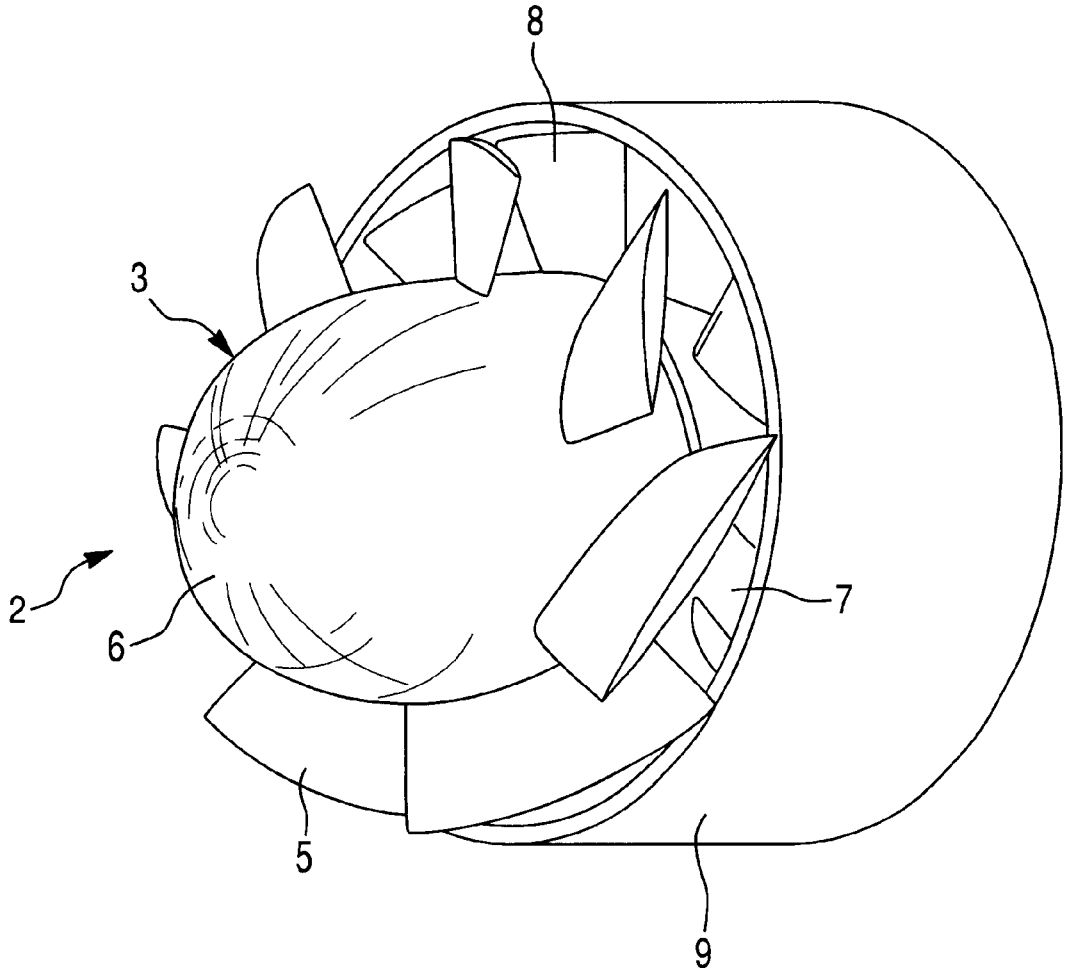
FIG. 3 is a perspective view of the stator formed with guide vanes.

The fan represented in FIG. 1, intended for cooling the engine of a motor vehicle, comprises a stator 1 and a rotor 2. The rotor 2 includes a bowl-shaped hub 3 featuring an axisymmetric wall 4, from which impeller blades 5 extend substantially radially outwards, and a curved bottom 6. An axisymmetric cylindrical wall 7, preferably of the same diameter as the wall 4, is situated axially facing the wall 4, at the opposite end to the bottom 6, and forms a central core for the stator 1, from which guide vanes 8 extend substantially radially outwards, substantially over the same radial height as the blades S. The core 7 and the hub 3 are integral respectively with the stator and with the rotor of an electric motor housed within the core and the hub. In a known way as best seen in FIG. 3, the radially outer extremities of the vanes 8 can be mutually connected by an annular peripheral ring 9, the latter, in the same way as the core 7, possibly being formed in a single piece with the vanes, especially by molding from a plastic or from a magnesium-based material.

Figure 2:
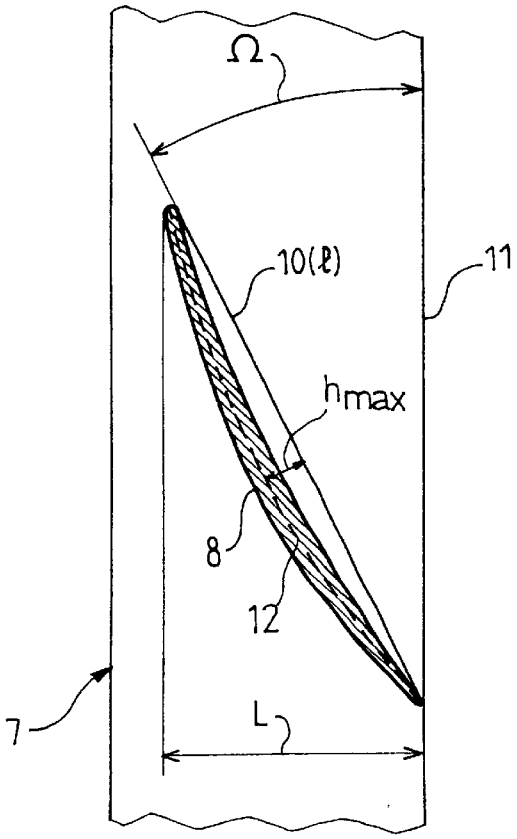
FIG. 2 is a partial view of the stator along a radial direction, showing the flattened cross section of a guide vane.

FIG. 2 partly shows the core 7 of the stator, in projection in a radial direction, as well as the flattened cross section of a guide vane 8, that is to say the flat, closed curve obtained by cutting the vane through a cylindrical surface axisymmetric about the axis of the fan, and by rolling this cylindrical surface out flat in the plane of the figure. This flattened cross section features an aircraft-wing profile, the chord 10 of which is inclined by an acute angle Ω with respect to a radial plane, such as that containing the downstream extremity 11 of the stator. The invention provides for the angle Ω, or angle of attack, to lie between 25 and 35°, and for it to decrease progressively as the cross section moves away from the axis, at least over the last 30% of the radial span of the vane.

FIG. 2 also depicts the axial length L of the vane 8, which, according to the invention, advantageously lies between 40 and 60 mm.

Also visible is the distance $h_{max}$ between the median line 12 of the profile of the vane and the chord 10 of length l.

The aerodynamic camber is the camber C of the median line 12. It is calculated from $h_{max}$ and from l by the following formula:

$$C = \frac{h_{\max}}{l} \cdot K,$$

K being an empirical constant which depends on the geometry and on the aerodynamics of the stator.

It has been observed that the optimised values proposed by the invention are suitable throughout the range of outer diameters and of rotational speeds used for motor-vehicle fans, that is to say from 200 to 500 mm and from 1500 to 4000 rpm.

What is claimed is:

1. A cooling fan in combination with a motor vehicle, provided to cool an engine, said fan comprising a stator and a rotor which is able to turn with respect to the stator about an axis in such a way as to produce a single airflow in a direction of said axis, the rotor and the stator respectively featuring blades and guide vanes which extend substantially radially into said airflow, the guide vanes being situated downstream of the blades with respect to the airflow, characterized in that the axial length of the guide vanes is equal to at least 40 mm, wherein said blades and said guide vanes are substantially the same radial height, wherein said single airflow flows in one direction.

2. A fan according to claim 1, in which the axial length of the guide vanes is equal to 60 mm at most.

3. A fan according to claim 1, in which an acute angle Ω between a chord of a flattened cross section of said vane and a radial plane lies between 25 and 35°.

4. A fan according to claim 3, in which the angle Ω decreases progressively at least over an outermost 30% of a radial span of the vane.

5. A fan according to claim 1, in which the vanes have an aerodynamic camber lying between 1.5 and 2.5.

6. A fan according to claim 1, in which the vanes are produced in a single piece with a substantially annular central core from which they extend substantially radially outwards.

7. The combination according to claim 6 further comprising, a motor disposed within said substantially annular core to drive said rotor.

8. A fan according to claim 1, in which the vanes are produced in a single piece with an annular peripheral ring from which they extend substantially radially inwards.

9. A fan according to claim 1, in which the vanes are molded from a material chosen from one of a plastic and a magnesium-based material.

10. A fan according to claim 1, in which the stator and the rotor have an outer diameter lying between 200 and 500 mm.

11. A fan according to claim 1, in which the rotor is able to turn at a speed lying between 1500 and 4000 rpm.

12. The combination according to claim 1, wherein said rotor includes a bowl shaped hub having an axisymmetrical wall wherein said rotor blades extend radially outward from said axisymmetrical wall.

13. The combination according to claim 1, wherein said fan has an optimal configuration where said stator and said rotor each have an outer diameter within a range from 200 mm to 500 mm and said rotor operates at a speed within a range from 1500 rpm to 4000 rpm.

* * * * *